US011149497B2

(12) United States Patent
von Gynz-Rekowski

(10) Patent No.: US 11,149,497 B2
(45) Date of Patent: Oct. 19, 2021

(54) DRILLING MOTOR WITH BYPASS AND METHOD

(71) Applicant: RIVAL DOWNHOLE TOOLS LC, Houston, TX (US)

(72) Inventor: Gunther HH von Gynz-Rekowski, Montgomery, TX (US)

(73) Assignee: Rival Downhole Tools LC, Houston, TX (US)

( * ) Notice: Subject to any disclaimer, the term of this patent is extended or adjusted under 35 U.S.C. 154(b) by 222 days.

(21) Appl. No.: 15/790,509

(22) Filed: Oct. 23, 2017

(65) Prior Publication Data

US 2018/0112466 A1 Apr. 26, 2018

Related U.S. Application Data

(60) Provisional application No. 62/411,782, filed on Oct. 24, 2016.

(51) Int. Cl.

| | |
|---|---|
| ***E21B 4/02*** | (2006.01) |
| ***E21B 21/08*** | (2006.01) |
| ***E21B 21/10*** | (2006.01) |
| ***E21B 4/00*** | (2006.01) |

(52) U.S. Cl.

CPC ..... *E21B 4/02* (2013.01); *E21B 4/003* (2013.01); *E21B 21/08* (2013.01); *E21B 21/103* (2013.01)

(58) Field of Classification Search

CPC . E21B 4/02; E21B 4/003; E21B 21/08; E21B 21/103; F16C 2352/00

See application file for complete search history.

(56) References Cited

U.S. PATENT DOCUMENTS

| | | | |
|---|---|---|---|
| 4,636,151 | A | 1/1987 | Eppink |
| 4,844,180 | A | 7/1989 | Zijsling |
| 5,667,023 | A | 9/1997 | Harrell et al. |
| 5,679,894 | A | 10/1997 | Kruger et al. |

(Continued)

FOREIGN PATENT DOCUMENTS

| | | |
|---|---|---|
| CA | 2924330 | 9/2016 |

OTHER PUBLICATIONS

International Search Report and Written Opinion dated Jan. 9, 2018 from Applicant's counterpart International (PCT) Application No. PCT/US2017/058064.

(Continued)

*Primary Examiner* — Blake E Michener
*Assistant Examiner* — Theodore N Yao
(74) *Attorney, Agent, or Firm* — Jones Walker LLP

(57) ABSTRACT

A downhole drilling motor includes a motor housing having an inner bore and an outer surface. A power section includes a stator elastomer at least partially disposed within the inner bore of the motor housing. A bearing section includes an upper bearing at least partially disposed within the inner bore of the motor housing. The motor housing further includes an opening extending from the inner bore to the outer surface to provide a bypass fluid path for a fluid in the inner bore. The opening is disposed on the motor housing between a lower end of the stator elastomer and an upper end of the upper bearing. The bypass fluid path allows the downhole drilling motor to accommodate a higher flow rate of a fluid through the stator elastomer of the power section than through the upper bearing of the bearing section.

9 Claims, 4 Drawing Sheets

(56) References Cited

U.S. PATENT DOCUMENTS

| | | | | |
|---|---|---|---|---|
| 6,183,226 | B1 * | 2/2001 | Wood | E21B 4/02 418/152 |
| 6,250,806 | B1 | 6/2001 | Beshoory | |
| 7,757,781 | B2 | 7/2010 | Hay et al. | |
| 8,181,720 | B2 * | 5/2012 | Prill | E21B 4/003 175/107 |
| 8,197,241 | B2 * | 6/2012 | Robisson | F04C 2/1075 418/152 |
| 2006/0283636 | A1 * | 12/2006 | Reagan | E21B 4/02 175/107 |
| 2015/0068811 | A1 | 3/2015 | Marchand et al. | |
| 2016/0312534 | A1 * | 10/2016 | Ficken | E21B 4/003 |

OTHER PUBLICATIONS

Extended European Search Report dated Apr. 28, 2020 in Applicant's counterpart European Application No. 17866283.9.

* cited by examiner

DRILLING MOTOR WITH BYPASS AND METHOD

CROSS-REFERENCE TO RELATED APPLICATION

The application claims the benefit of and priority to U.S. Provisional Patent Application No. 62/411,782 filed on Oct. 24, 2016, which is incorporated herein by reference in its entirety.

BACKGROUND

In the process of drilling oil and gas wells, downhole drilling motors may be connected to a drill string to rotate and steer a drill bit. Conventional drilling motors typically include a power section, a transmission section, and a bearing section. Rotation is provided by the power section that may be a positive displacement motor driven by circulation of drilling fluid or drilling mud. The transmission section transmits torque and speed from the power section to a drill bit disposed at a lower end of the drilling motor. The bearing section takes up the axial and radial loads imparted on the drill string during drilling.

As wellbores are drilled faster, higher flow rates of drilling fluid are required to clear drill cuttings from the wellbore. Each drilling motor is designed to function with a maximum flow rate of the drilling fluid. For example, a conventional drilling motor having an outer diameter of 6.75 inches may be designed for a maximum flow rate of about 600 gallons per minute (GPM). Exceeding the maximum flow rate for a drilling motor may cause premature failure of the bearing section due to erosion.

BRIEF DESCRIPTION OF THE DRAWING VIEWS

DETAILED DESCRIPTION OF SELECTED EMBODIMENTS

A drilling motor with a bypass flow path, also referred to as a bypass drilling motor, is disclosed herein. The bypass drilling motor may include one or more openings in or near a transmission section, i.e., between a lower end of a stator elastomer of the power section and an upper most bearing of the bearing section. The one or more openings may allow a portion of a drilling fluid flowing through a central portion of the drilling motor to exit the drilling motor between the stator elastomer and the upper bearing, instead of continuing to flow through the drilling motor to the bearing section and the drill bit. Providing a bypass opening effectively reduces the fluid flow rate through the bearing section and drill bit while allowing an overall higher flow rate through the wellbore. In this way, wellbores may be drilled faster with higher flow rates of drilling fluid through the drilling motor without causing premature erosion failure of the bearing section of the drilling motor.

Figure 1A:
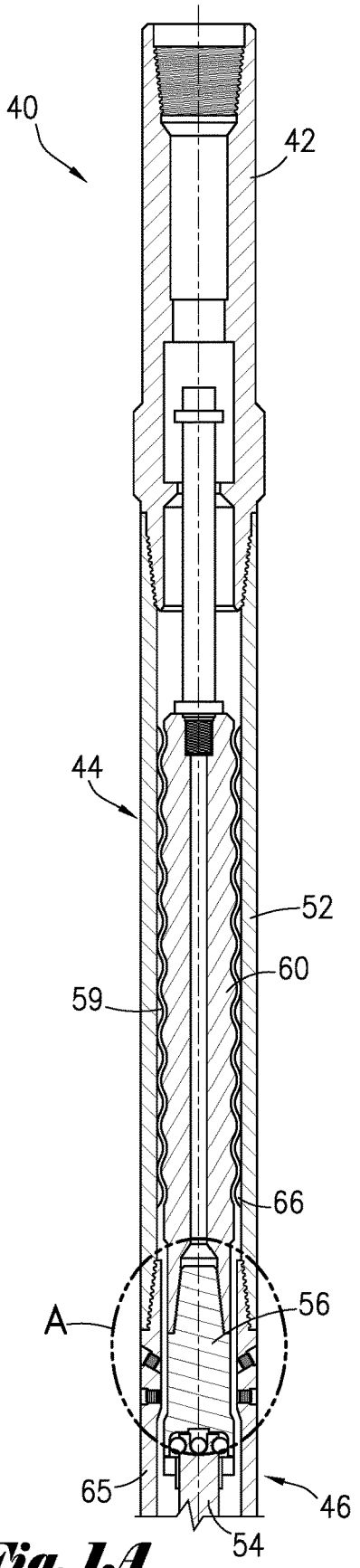
FIGS. 1A and 1B are sequential schematic views of a drilling motor with a bypass flow path.
Figure 1B:
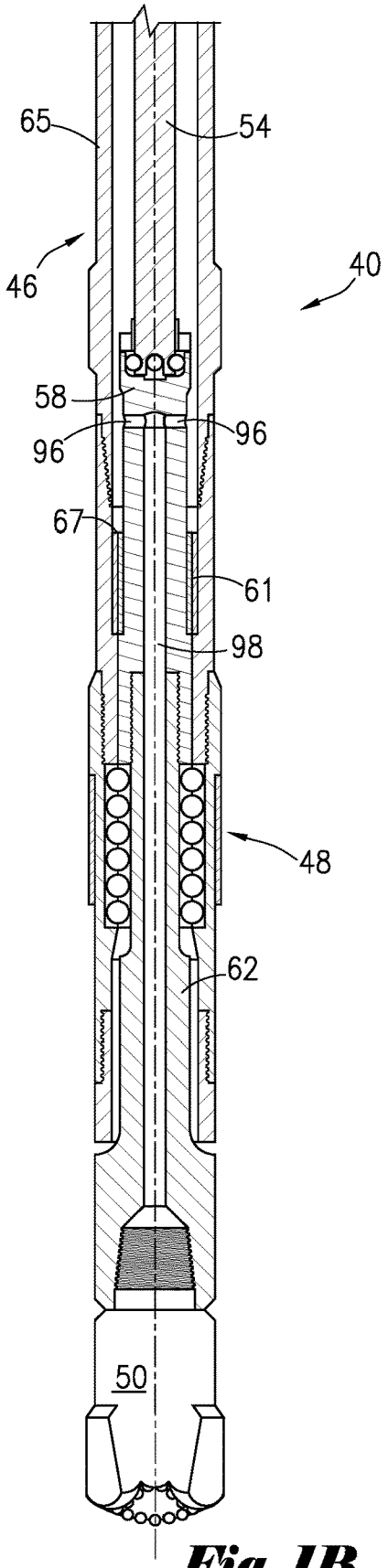
Figure 2:
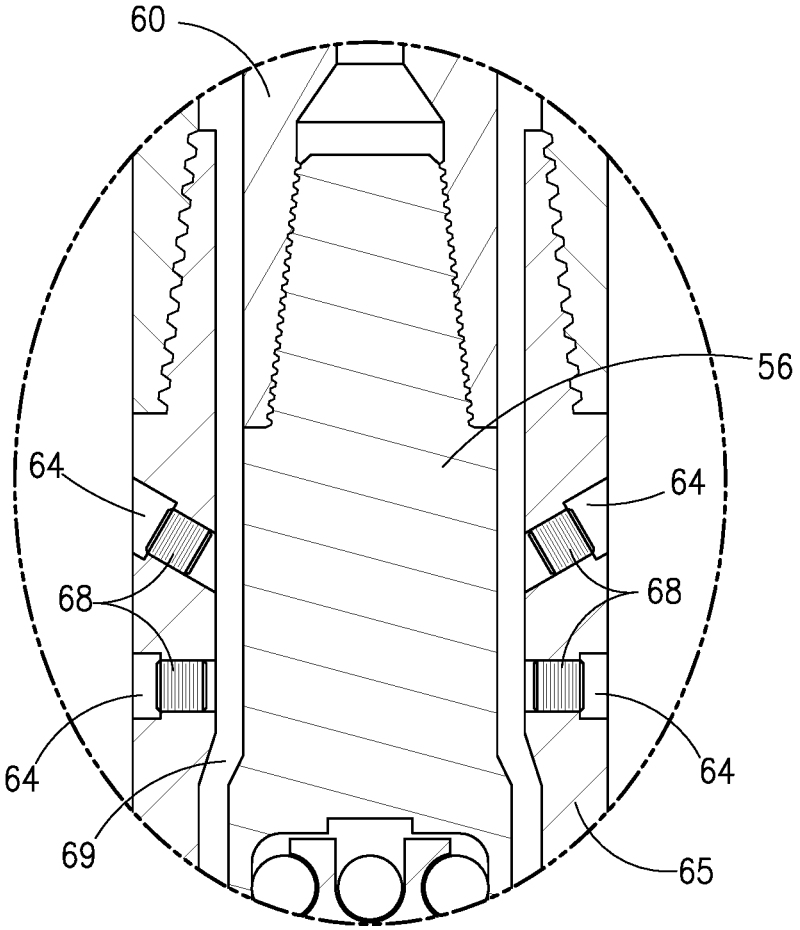
FIG. 2 is a detail view of the drilling motor shown in FIGS. 1A and 1B taken from area A in FIG. 1A.

FIGS. 1A-2 illustrate drilling motor 40 including top sub 42, power section 44, transmission section 46, bearing section 48, drill bit 50, and motor housing 52. Motor housing 52 may extend from top sub 42 to bearing section 48, and may be formed of a single component or multiple components. For example, motor housing 52 may include a power housing, a transmission housing, and a bearing housing. Transmission section 46 may include transmission shaft 54, rotor adapter 56, and drive shaft adapter 58 disposed within motor housing 52. Power section 44 may include stator elastomer 59 secured within motor housing 52 and rotor 60 rotatably disposed within stator elastomer 59. In one embodiment, stator elastomer 59 includes a helically-contoured inner surface and rotor 60 includes a helically-contoured outer surface; together, stator elastomer 59 and rotor 60 define a positive displacement power section having a helically-shaped progressive cavity. Bearing section 48 may include upper bearing 61 and rotatable drive shaft 62 disposed within motor housing 52. In one embodiment, upper bearing 61 is the only bearing included in bearing section 48. In other embodiments, bearing section 48 includes upper bearing 61 and one or more other bearings disposed below upper bearing 61. Upper bearing 61 may be a radial bearing, a thrust bearing, or a bearing that accommodates a combination of a thrust load and a radial load.

Rotor adapter 56 of transmission section 46 may be coupled to rotor 60 to transmit torque from power section 44 to transmission section 46. Drive shaft adapter 58 may be operatively coupled to drive shaft 62 of bearing section 48 to transmit torque from transmission section 46 to drive shaft 62 and drill bit 50. Transmission shaft 54 may be coupled to rotor adapter 56 and drive shaft adapter 58 to transmit torque through transmission section 46.

Drilling motor 40 may include one or more openings 64 through motor housing 52. In this embodiment, openings 64 may be positioned in transmission housing 65. In other embodiments, openings 64 may be positioned through other components of motor housing 52 between lower end 66 of stator elastomer 59 in power section 44 and upper end 67 of upper bearing 61 in bearing section 48.

Each of openings 64 provides a bypass fluid path through motor housing 52 (i.e., from an inner cavity to an outer surface of the housing). Motor housing 52 may include any number of openings 64 suitable for providing a desired bypass flow rate of fluid therethrough. For example, motor housing 52 may include 1-10 openings 64. In one embodiment, motor housing 52 may include 2-3 openings 64. In other embodiments, motor housing 52 may include more than 10 openings 64. Some embodiments of motor housing 52 may include a large number of micro-openings (e.g., several hundred to over 1,000 micro-openings), such as openings in a mesh or screen positioned in or near an opening in motor housing 52. In certain embodiments, openings 64 alone may provide the bypass fluid paths. In other embodiments, a nozzle 68 may be disposed in each opening 64, and each bypass fluid path may run through one of nozzles 68. Each opening 64 and/or each nozzle 68 may be formed of tungsten carbide or a ceramic material to prevent erosion. Each opening 64 and/or nozzle 68 may be sized to provide the desired bypass flow rate of fluid therethrough. For example, each opening 64 or each nozzle 68 may have an opening diameter between 7/32 inches and 28/32 inches. Openings 64 and/or nozzles 68 may be arranged in any configuration and may direct fluid flow in any direction.

A fluid (e.g., drilling fluid or mud) may be pumped from the well surface through a drill string or drill pipe to drilling motor 40. The fluid may flow through the cavity formed between rotor 60 and stator elastomer 59 to drive a rotation of rotor 60 within stator elastomer 59. Rotor 60 may orbit around the inner surface of stator elastomer 59. Transmission shaft 54 may transmit the rotational movements of rotor 60 to drive shaft 62. Drive shaft 62 may rotate concentrically within motor housing 52 to drive drill bit 50.

The fluid flowing between rotor 60 and stator elastomer 59 of power section 44 may flow into annular space 69 between rotor adapter 56 and motor housing 52. The fluid may continue flowing through the annular space between transmission shaft 54 and motor housing 52, the annular space between drive shaft adapter 58 and motor housing 52, through inlet ports 96 provided on drive shaft 62, through central bore 98 of drive shaft 62, and out through drill bit 50 to flush cuttings from the wellbore. In an alternate embodiment, inlet ports may be provided on a portion of transmission shaft 54 or drive shaft adapter 58 for fluid flow from the annular space (between transmission shaft 54/drive shaft adapter 58) into the central bore. In either embodiment, a portion of the fluid in the annular space between drive shaft adapter 58 and motor housing 52 may flow through the bearing elements in bearing section 48. For example, a portion of the fluid may flow through upper bearing 61.

A bypass flow may be established as a portion of the fluid in annular space 69 flows from space 69 through each of openings 64 and/or nozzles 68 out into an annular space between motor housing 52 and the wall of the well bore. A total bypass flow rate may be set by the number of openings 64 and/or nozzles 68 and the opening size of each opening 64 or nozzle 68. Use of a greater number of openings or nozzles may provide a higher bypass flow rate. Use of larger diameter openings or nozzles may provide a higher bypass flow rate. The bypass flow reduces the flow rate of fluid through the bearing elements in bearing section 48.

Figure 3A:
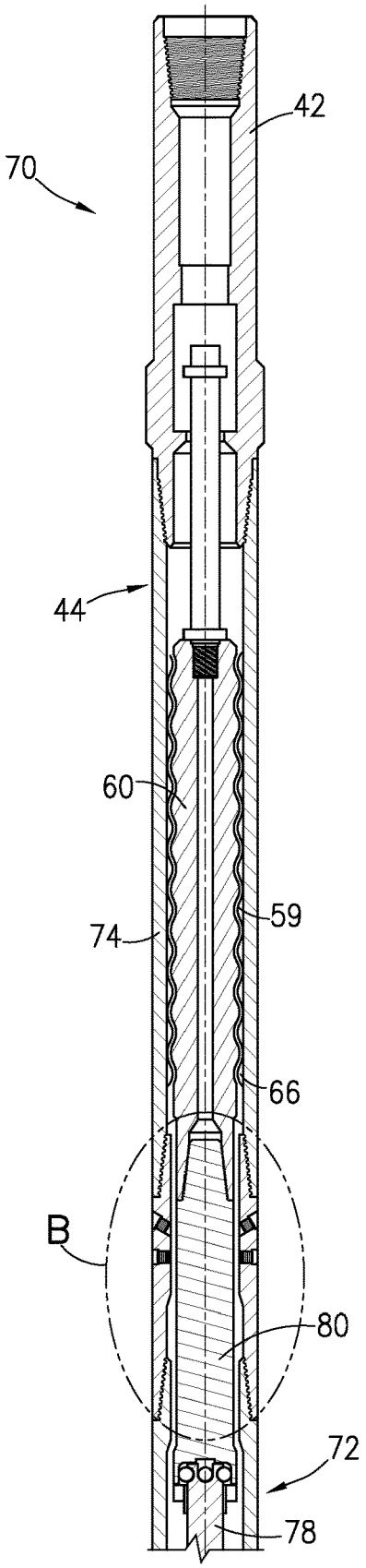
FIGS. 3A and 3B are sequential schematic views of an alternate drilling motor with a bypass flow path.
Figure 3B:
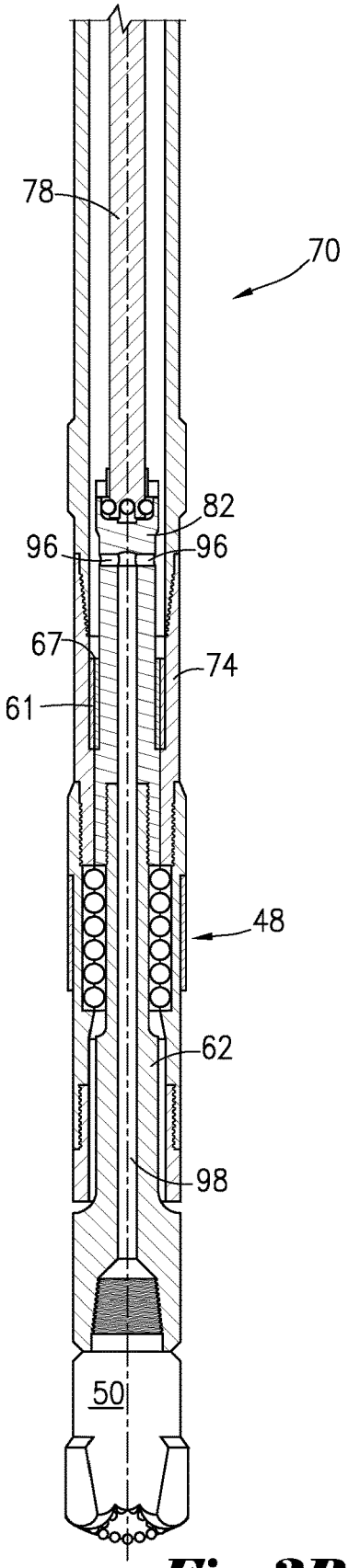
Figure 4:
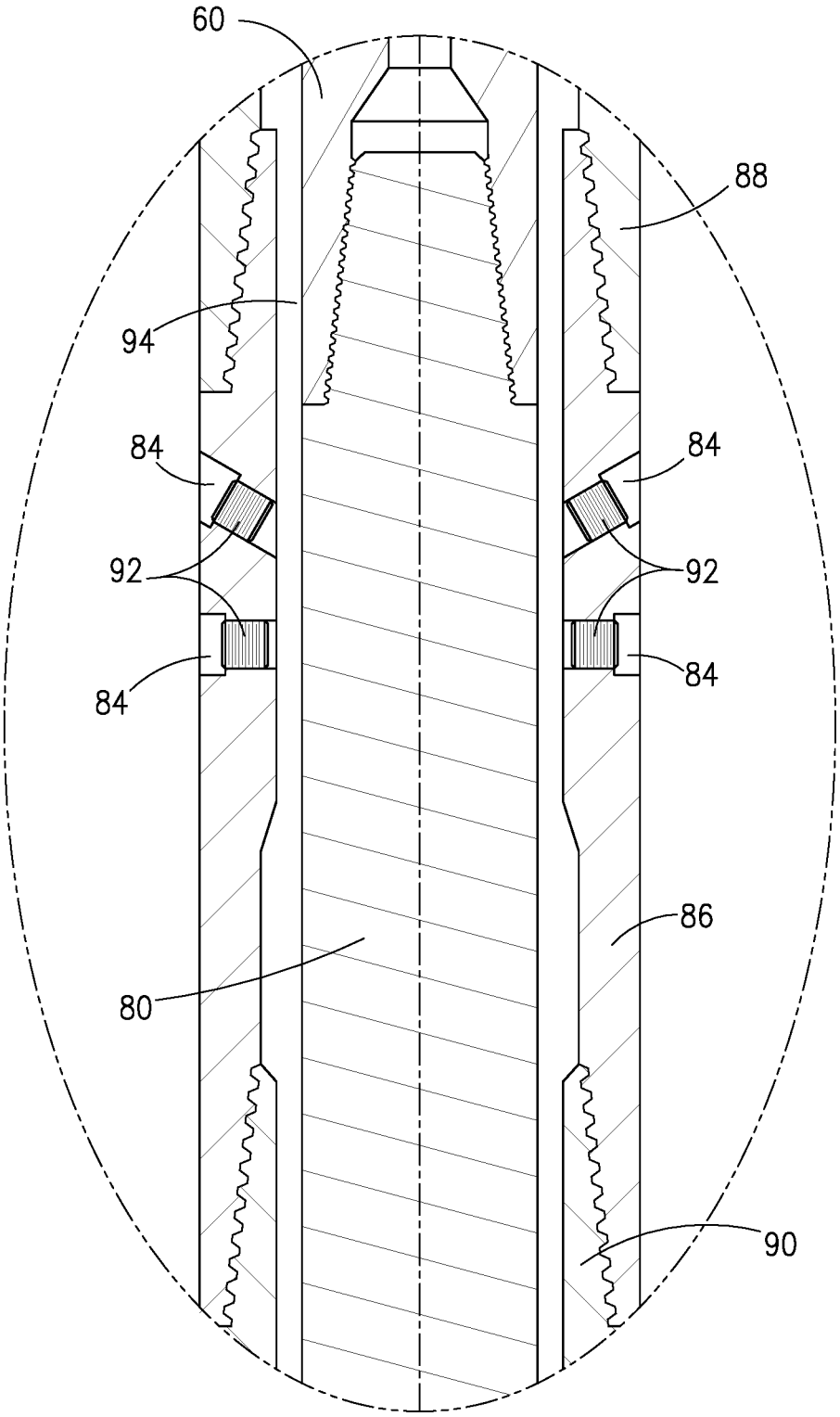
FIG. 4 is a detail view of the drilling motor shown in FIGS. 3A and 3B taken from area B in FIG. 3A.

FIGS. 3A-4 illustrate drilling motor 70 including top sub 42, power section 44, transmission section 72, bearing section 48, drill bit 50, and motor housing 74. Top sub 42, power section 44, bearing section 48, and drill bit 50 may include the same features and function in the same manner as describe above in connection with drilling motor 40. Motor housing 74 may extend from top sub 42 to drill bit 50, and may be formed of a single component or multiple components. For example, motor housing 52 may include a power housing, one or more transmission housings, and a bearing housing. Transmission section 72 may include transmission shaft 78, rotor adapter 80, and drive shaft adapter 82 disposed within motor housing 74. Rotor adapter 80 may be coupled between rotor 60 and transmission shaft 78. Drive shaft adapter 82 may be coupled between transmission shaft 78 and drive shaft 62.

Drilling motor 70 may also include one or more openings 84 through motor housing 74. In this embodiment, openings 84 may be positioned in nozzle housing 86 interconnected between power section housing 88 and transmission housing 90. In other embodiments, openings 84 may be positioned through other components of motor housing 74 between lower end 66 of stator elastomer 59 in power section 44 and upper end 67 of upper bearing 61 in bearing section 48.

Each of openings 84 provides a bypass fluid path through motor housing 74 (i.e., from an inner cavity to an outer surface of the housing). Motor housing 74 may include any number of openings 84 suitable for providing a desired bypass flow rate of fluid therethrough. For example, motor housing 74 may include 1-10 openings 84. In one embodiment, motor housing 74 may include 2-3 openings 84. In certain embodiments, openings 84 alone may provide the bypass fluid paths. In other embodiments, a nozzle 92 is disposed in each opening 84, and each bypass fluid path may run through one of nozzles 92. Each opening 84 and/or nozzle 92 may be formed of carbide to prevent erosion. Each opening 84 and/or nozzle 92 may be sized to provide the desired bypass flow rate of fluid therethrough. For example, each opening 84 or each nozzle 92 may have an opening diameter between 7/32 inches and 28/32 inches. Openings 84 and/or nozzles 92 may be arranged in any configuration and may direct fluid flow in any direction. Except for the noted differences, openings 84 and nozzles 92 may include the same design features, and may function in the same manner, as openings 64 and nozzles 68 in drilling motor 40.

The fluid flowing through rotor 60 and stator elastomer 59 of power section 44 may flow into annular space 94 between rotor adapter 80 and motor housing 74. A bypass flow may be established as a portion of the fluid in annular space 94 flows from space 94 through each of openings 84 and nozzles 92 out into an annular space between motor housing 74 and the wall of the well bore. A total bypass flow rate may be set by the number of openings 84 and/or nozzles 92 and the opening size of each opening 84 or nozzle 92. Use of a greater number of openings/nozzles and/or use of larger diameter openings/nozzles may provide a higher bypass flow rate. The bypass flow reduces the flow rate of fluid through the bearing elements in bearing section 48.

Drilling motors 40, 70 may accommodate a flow rate of a drilling fluid that is higher than a maximum allowable flow rate of bearing section 48 by providing a bypass flow through openings 64, 84 and/or nozzles 68, 92. For example, but not by way of limitation, if a 6¾" bearing section 48 is rated for a maximum drilling fluid flow rate of 600 GPM, drilling motor 40, 70 may accommodate a drilling fluid flow rate of 900 GPM through power section 44 (to provide faster drilling) by allowing a bypass flow rate of 300 GPM through openings 64, 84 and/or nozzles 68, 92. In an alternate example, but not by way of limitation, if the maximum design flow rate of bearing section 48 is 600 GPM, drilling motor 40, 70 may accommodate a flow rate of 700 GPM through power section 44 by providing a bypass flow rate of 100 GPM through openings 64, 84 and/or nozzles 68, 92.

In these examples, the bypass flow rate may be set by the total area of the opening(s) of openings 64, 84 and/or nozzle(s) 68, 92 (i.e., the number of nozzles and/or the size of each nozzle) in drilling motor 40, 70, respectively. In embodiments including more than one opening 64, 84 and/or more than one nozzle 68, 92, the total area of the openings is the sum of the area of each of the openings. The total area of the opening(s) may be set with calculations for a desired fluid flow rate through power section 44. The pressure drop across the bypass openings must equal the pressure drop over the bearing section and drill bit.

The following formula provides one example of a method of calculating the total flow area of openings 64, 84 and/or nozzle(s) 68, 92 in drilling motor 40, 70, respectively, for a desired fluid flow rate through power section 44:

$$A = \sqrt{\frac{W(Q_p - Q_b)^2}{12031 P_{b+d}}}$$

where A is the total flow area of the nozzle (in square inches), W is the weight of the drilling fluid (in PPG), $Q_p$ is the desired fluid flow rate through power section 44 (in GPM), $Q_b$ is the maximum fluid flow rate that bearing section 48 is designed to accommodate (in GPM), and $P_{b+d}$ is a measured or calculated pressure drop across bearing section 48 and drill bit 50 (in psi) for the maximum fluid flow rate $Q_b$ that bearing section 48 is designed to accommodate.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A downhole drilling motor comprising:

a motor housing comprising a power housing having an inner bore and an outer surface, a transmission housing having an inner bore and an outer surface, and a bearing housing having an inner bore and an outer surface, wherein the power housing is threadedly connected to the transmission housing and the transmission housing is threadedly connected to the bearing housing;

a power section including a stator elastomer and a rotor at least partially disposed within the inner bore of the power housing, the rotor having an upper end and a lower end, the lower end of the rotor directly coupled to an upper end of a rotor adapter;

a transmission section including a transmission shaft disposed within the inner bore of the transmission housing, the transmission shaft comprising a solid shaft without a central inner bore, the transmission shaft having an upper end and a lower end, the upper end of the transmission shaft directly coupled to a lower end of the rotor adapter;

a bearing section including an upper bearing disposed within the inner bore of the bearing housing; and a first opening through the transmission housing, the first opening disposed below the stator elastomer and the lower end of the rotor and above the transmission shaft and the bearing section, wherein the first opening extends from the inner bore to the outer surface of the transmission housing to provide a bypass fluid path for a fluid from the inner bore to the outer surface.

2. The downhole drilling motor of claim 1, further comprising one or more additional openings through the transmission housing, wherein each of the one or more additional openings is disposed below the stator elastomer and the rotor and above the transmission shaft and the bearing section, wherein each of the one or more additional openings extends from the inner bore to the outer surface of the transmission housing to provide the bypass fluid path for the fluid from the inner bore to the outer surface.

3. The downhole drilling motor of claim 2, wherein a defined bypass fluid flow rate through the bypass fluid path depends on (i) a pressure drop created by a fluid flow through the bearing section and a drill bit of the downhole drilling motor and (ii) a total flow area of the bypass fluid path.

4. The downhole drilling motor of claim 3, wherein the first opening and the one or more additional openings each has a diameter between 7/32 inches and 28/32 inches.

5. The downhole drilling motor of claim 3, wherein the first opening and the one or more additional openings each has a nozzle disposed therein through which the bypass fluid path runs.

6. A downhole drilling motor comprising:

a motor housing comprising a power housing having an inner bore and an outer surface, a transmission housing having an inner bore and an outer surface, and a bearing housing having an inner bore and an outer surface, wherein the power housing is threadedly connected to the transmission housing and the transmission housing is threadedly connected to the bearing housing;

a power section including a stator elastomer and a rotor at least partially disposed within the inner bore of the power housing, the rotor having an upper end and a lower end, the lower end of the rotor directly coupled to an upper end of a rotor adapter;

a transmission section including a transmission shaft disposed within the inner bore of the transmission housing, the transmission shaft comprising a solid shaft without a central inner bore, the transmission shaft having an upper end and a lower end, the upper end of the transmission shaft directly coupled to a lower end of the rotor adapter;

a bearing section including an upper bearing partially disposed within the inner bore of the bearing housing;

a first opening through the transmission housing, the first opening disposed below the stator elastomer and the lower end of the rotor and above the transmission shaft and the bearing section, wherein the first opening extends from the inner bore to the outer surface of the transmission housing; and a first nozzle disposed in the first opening through the transmission housing, the first nozzle configured to provide a bypass fluid path from the inner bore to the outer surface of the transmission housing for a fluid from the inner bore to the outer surface.

7. The downhole drilling motor of claim 6, further comprising one or more additional openings through the transmission housing and one or more additional nozzles, each of the one or more additional nozzles disposed in one of the one or more additional openings through the transmission housing, wherein each of the one or more additional openings is disposed below the stator elastomer and the rotor and above the transmission shaft and the bearing section, wherein each of the one or more additional openings extends from the inner bore to the outer surface of the transmission housing, and wherein each of the one or more additional nozzles provides the bypass fluid path from the inner bore to the outer surface of the transmission housing.

8. The downhole drilling motor of claim 7, wherein a defined bypass fluid flow rate through the bypass fluid path depends on (i) a pressure drop created by a fluid flow through the bearing section and a drill bit of the downhole drilling motor and (ii) a total flow area of the bypass fluid path.

9. The downhole drilling motor of claim 8, wherein the first nozzle and the one or more additional nozzles each has an opening with a diameter between 7/32 inches and 28/32 inches.

* * * * *